US007963723B2

(12) United States Patent
Wurm et al.

(10) Patent No.: US 7,963,723 B2
(45) Date of Patent: Jun. 21, 2011

(54) OVERDRILLING APPARATUS

(75) Inventors: Dieter Wurm, Kirchundem (DE); Hans-Joachim Bayer, Kohlberg (DE); Udo Harer, Straubenhardt (DE)

(73) Assignee: Tracto-Technik GmbH, Lennestadt (DE)

( * ) Notice: Subject to any disclaimer, the term of this patent is extended or adjusted under 35 U.S.C. 154(b) by 1110 days.

(21) Appl. No.: 11/551,391

(22) Filed: Oct. 20, 2006

(65) Prior Publication Data

US 2007/0119283 A1 May 31, 2007

(30) Foreign Application Priority Data

Oct. 21, 2005 (DE) ..... 10 2005 050 932

(51) Int. Cl.
*E21B 7/28* (2006.01)

(52) U.S. Cl. ..... 405/184.1; 175/53

(58) Field of Classification Search ..... 175/53, 175/62, 61, 107; 405/184, 184.1, 184.3; 138/98, 99

See application file for complete search history.

(56) References Cited

U.S. PATENT DOCUMENTS

| | | | | |
|---|---|---|---|---|
| 3,870,370 | A * | 3/1975 | Winberg et al. | 299/106 |
| 6,176,328 | B1 * | 1/2001 | Caraway et al. | 175/325.5 |
| 6,308,789 | B1 * | 10/2001 | Kuenzi et al. | 175/61 |

FOREIGN PATENT DOCUMENTS

| | | | |
|---|---|---|---|
| CA | 1034882 | A * | 7/1978 |
| DE | 195 04 484 | C1 | 9/1996 |
| DE | 20218713 | U1 * | 4/2003 |
| DE | 202 18 713 | U1 | 5/2003 |
| GB | 2126436 | A * | 3/1984 |
| GB | 2 389 382 | A | 7/2002 |
| GB | 2386767 | A * | 9/2003 |
| WO | WO 02053866 | A2 * | 7/2002 |

* cited by examiner

*Primary Examiner* — Daniel P Stephenson

(74) *Attorney, Agent, or Firm* — Henry M. Feiereisen; Ursula B. Day

(57) ABSTRACT

An apparatus for overdrilling a buried line includes a rotatably driven thrust linkage and/or traction linkage, and has a forward end which is connected to a ring-shaped to hollow cylindrical overdrilling head which embraces the line. The overdrilling head is provided interiorly with a centering protrusion for spontaneous centering of the overdrilling head in concert with the line.

22 Claims, 4 Drawing Sheets

OVERDRILLING APPARATUS

CROSS-REFERENCES TO RELATED APPLICATIONS

This application claims the priority of German Patent Application, Serial. No. 10 2005 050 932.0, filed Oct. 21, 2005, pursuant to 35 U.S.C. 119(a) (d).

BACKGROUND OF THE INVENTION

The present invention relates, in general, to an apparatus for overdrilling of buried pipes.

Nothing in the following discussion of the state of the art is to be construed as an admission of prior art.

An overdrilling apparatus is used to clear buried cables and pipelines (hereinafter called "lines") without excavations and then to renew them. This is realized with the aid of a flushing liquid for example, optionally assisted by cutting and reaming tools, to create a ring channel which surrounds the line and allows the old line to be pulled or pushed out with little friction as well as a new line to be pulled or pushed in.

German Pat. No. DE 195 04 484 C1 describes an overdrilling apparatus which includes a linkage having a forward end for arrangement of a ring-shaped overdrilling head which embraces the old line and includes nozzles for discharge of a flushing liquid, with the nozzles pointing in advance direction. Approximately half of the wall of the ring-shaped overdrilling head has a substantially crescent-shaped cross section for attachment of the linkage which extends to the side of the old line. The flushing liquid migrates via the linkage to nozzles which are arranged in irregular spaced-apart relationship in a ring-shaped manner and have length and jet axes in parallel relationship to the length axis of the overdrilling head. The nozzle jets are intended to flush out the line so long as permitted by the soil consistency and to create hereby in concert with the overdrilling head an annular space which is intended to allow a line exchange with little friction.

However, this is achieved oftentimes only insufficiently because the liquid jets of the nozzles, arranged in the form of a ring at a distance to the old line, cannot reach the line surface, at least not to the extent and with the intensity required for removal of deposits, in view of the parallel disposition of their axes in relation to the length axis of the line and the overdrilling head, respectively. Moreover, in order to reduce the friction between overdrilling head and line, the inner diameter of the overdrilling head of conventional devices exceeds the outer diameter of the line. In this way, an annular gap is created between the overdrilling head and the line, whereby the annular gap has a width which varies, however, locally because the line continuously shifts radially in relation to the overdrilling head under the influence of the soil and the gravitational force acting upon the line. As a result, the width of the annular gap constantly changes locally, i.e. the line and the overdrilling head no longer assume a coaxial relationship. This is accompanied by the risk that tools arranged at the end surface of the overdrilling head can touch and damage the line. Furthermore, soil can migrate into the annular gap between the overdrilling head and the line and may settle there and/or stabilize an unwanted eccentric disposition of the overdrilling head.

It would therefore be desirable and advantageous to provide an improved overdrilling apparatus which obviates prior art shortcomings and constructed to not only center the overdrilling head when clearing an underground line without excavation but also to liberate optionally the surface of the line from adherents.

SUMMARY OF THE INVENTION

According to one aspect of the present invention, an apparatus for overdrilling a buried line includes a rotatably driven linkage, and a hollow cylindrical overdrilling head operated by the linkage and provided interiorly with at least one centering protrusion.

The present invention resolves prior art problems by providing the centering protrusion inside of the overdrilling head so as to ensure a substantial concentric disposition between overdrilling head and line.

According to another feature of the present invention, the centering protrusion may be constructed in the form of a ring-shaped centering bead which has an approximately partial circular contour. Thus, the contact surface between the centering bead and the line is small. The centering bead is hereby sized enough to prevent cutting and reaming tools on the overdrilling head to come into contact with the old line.

According to another feature of the present invention, the overdrilling head may be provided with at least one nozzle which is disposed on the overdrilling head and defined by an exit axis which points slantingly with respect to a length axis of the overdrilling head. Thus, the end surface of the at least one nozzle is inclined in direction of the line. As a result, the jets exiting the nozzle impact the line surface and peel off adherents that are present there. An added benefit of this configuration is the fact that an annular space between the overdrilling head and the line remains free of contaminants so that the operativeness of the centering bead is ensured, even when ground conditions are difficult.

According to another feature of the present invention, a plurality of nozzles may be disposed on the overdrilling head, wherein a first group of nozzles points in an advance direction of the overdrilling head, and a second group of nozzles points in an opposite direction and are inclined at least partly in direction of the old line so that the old line can be further cleaned and separated soil can be removed with the flushing liquid.

According to another feature of the present invention, a nozzle ring may be connected to the overdrilling head for arrangement of at least some of the nozzles. In this way, the overdrilling apparatus according to the invention can be operated with different or differently inclined nozzles. Thus, nozzles and/or tools equipped with widely different nozzle rings can be easily used on the overdrilling head through simple exchange, or also worn nozzle rings can be replaced.

According to another feature of the present invention, the nozzle ring can be rotatably supported and connected with a rotary drive. The rotary drive may act in two effective directions to enable a back-and-forth rotation.

According to another feature of the present invention, the linkage may also be connected to a rotary drive acting in two effective directions to thereby allow a back-and-forth movement of the overdrilling head so that each nozzle and each tool can be moved on a partial circle.

According to another feature of the present invention, the overdrilling head—with or without centering—may be connected flexibly with the linkage. This keeps the overdrilling head substantially free of interfering forces emanating from the linkage because the overdrilling head is able to shift sideways—within limits—independently from the linkage. In order to detect a lateral shift during overdrilling, a measuring device may be installed between the overdrilling head and the linkage for locating the drilling head to enable a positional determination of the overdrilling head on the earth's surface. Deviations are thus immediately detectable. As a consequence, overstress of the drilling tool can be prevented and it can be ascertained when the desired route and the actual route do not coincide.

According to another feature of the present invention, the flexible connection between the overdrilling head and the linkage may be made from a pliant pipe piece in which the channel for the linkage continues.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
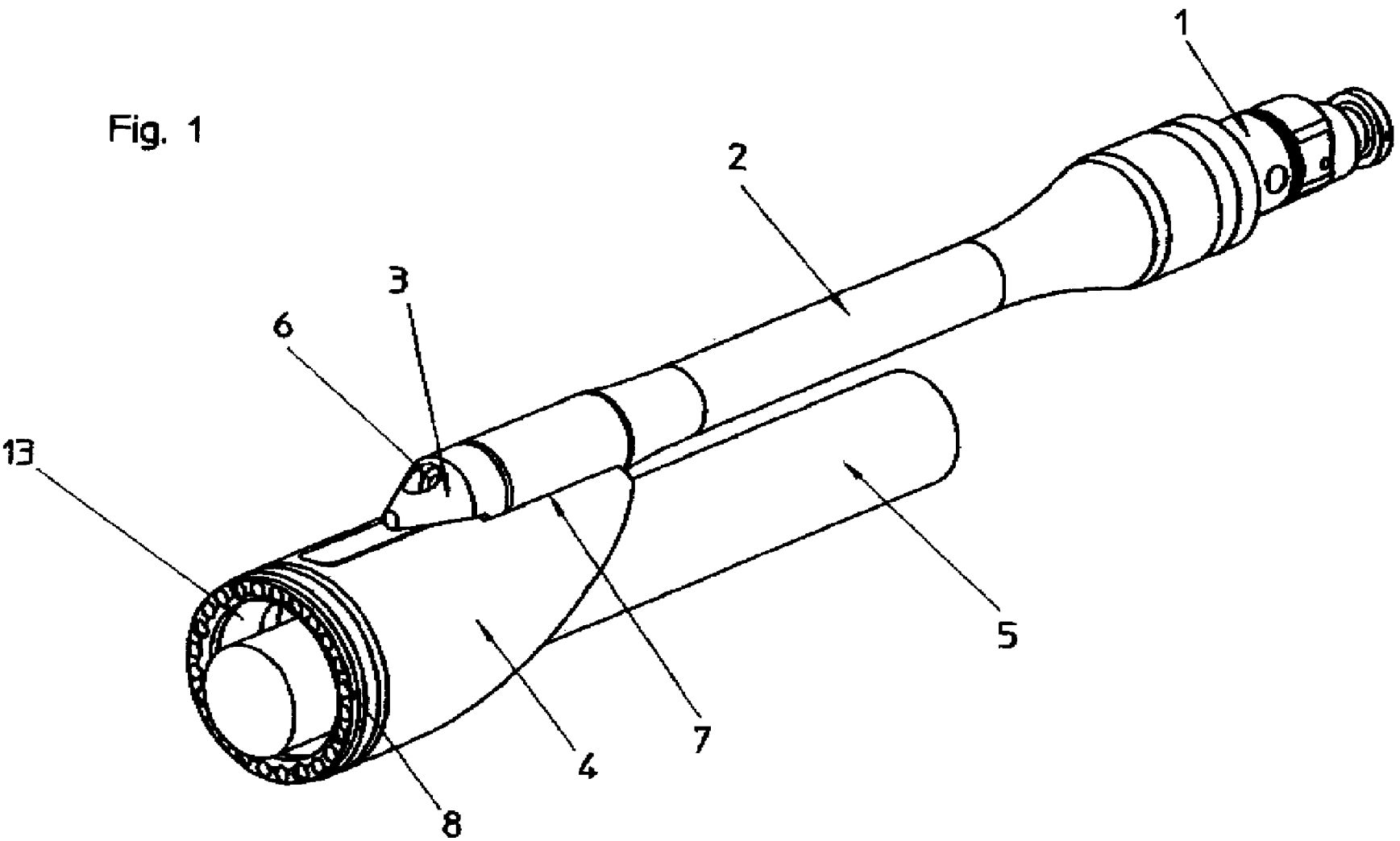
FIG. 1 is a perspective illustration of an overdrilling apparatus according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a perspective illustration of an overdrilling apparatus according to the present invention, including a linkage 1 which is rotationally driven by an unillustrated thrust drive and/or traction drive and shown here only by way of the forward part. The linkage 1 is connected via a bendable or flexible pipe piece 2 and an attachment piece 3 to a hollow cylindrical overdrilling head, generally designated by reference numeral 4. A measuring device for locating a position of the overdrilling head 4 may be arranged in the linkage 1 and includes a transmitter to generate signals which serve aboveground to position the overdrilling head 4 with the aid of the rotatable linkage 1 for example.

The attachment piece 3 engages with its forward end a substantially U-shaped recess 7 in the outer surface area of the overdrilling head 4 which embraces coaxially an old line 5 extending in substantial parallel relationship to the linkage 1 and which has a slanted rearward end. The attachment piece 3 is provided with a nozzle 6 and connects laterally to the overdrilling head 4 which at the same time embraces the attachment piece 3 with its U-shaped recess 7 in a substantially horseshoe-like manner. As a result, the connection between the overdrilling head 4 and the attachment piece 3 is extremely stable and rigid.

Figure 4:
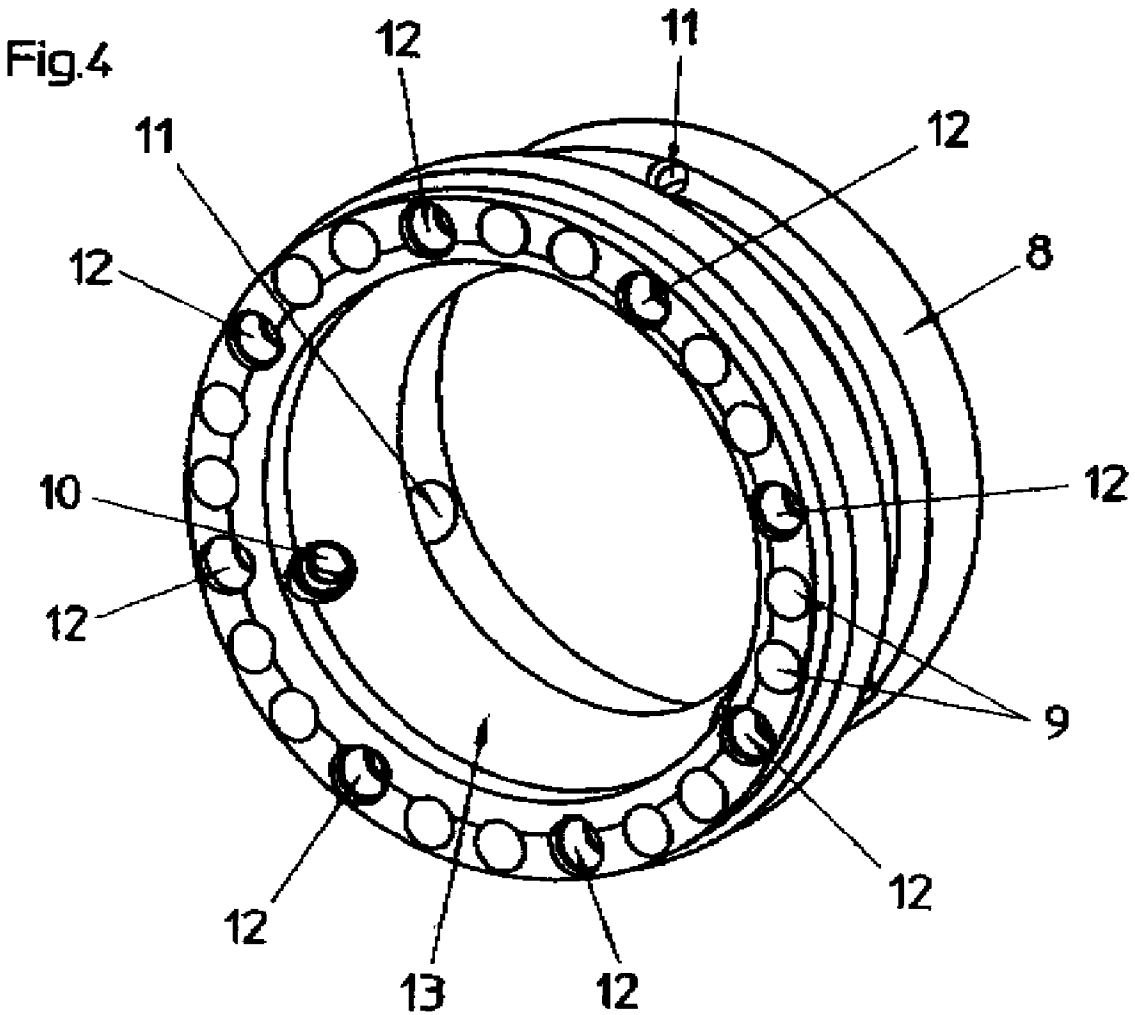
FIG. 4 is a perspective illustration of a nozzle ring.

The overdrilling head 4 receives a nozzle ring 8 which is rounded at the end surface for preventing damage to the line 5 and which is shown in greater detail in FIGS. 1 and 4. The nozzle ring 8 is provided with cutting and reaming tools 9, nozzles 10, 12, which point in an advance direction of the overdrilling apparatus, and nozzles 11, which point in opposite direction, as shown schematically. The nozzle ring 8 may be rotatably arranged on the overdrilling head 4 and operated by a separate, not shown, rotary drive. The exit directions of the nozzles 12 extend parallel to the length axes of the old line 5 and the nozzle ring 8, while the nozzles 10, 11 are inclined so that exiting jets impact at least a major part of the line 5.

Arranged between the front nozzles 10, 12 are the cutting and reaming tools 9—only indicated schematically—for cutting free more stable or harder soil constituents.

Figure 2:
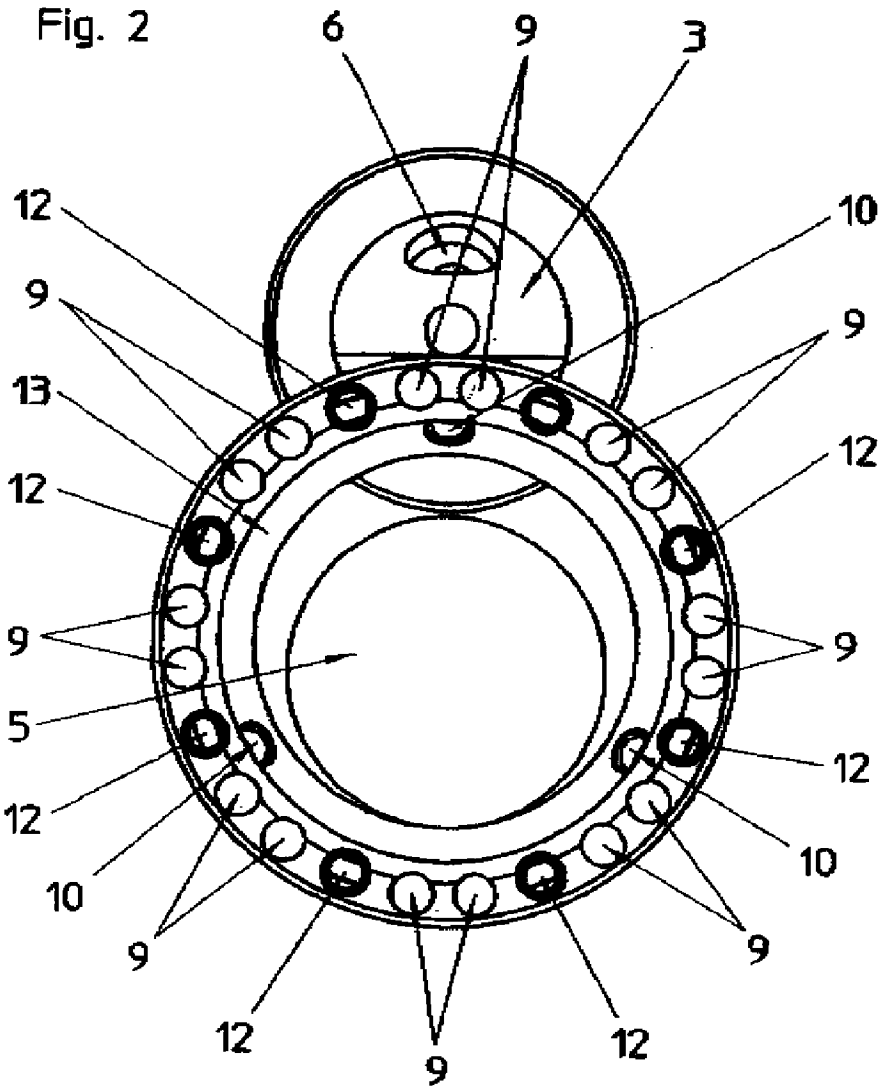
FIG. 2 is a frontal sectional view of the overdrilling apparatus of FIG. 1.
Figure 3:
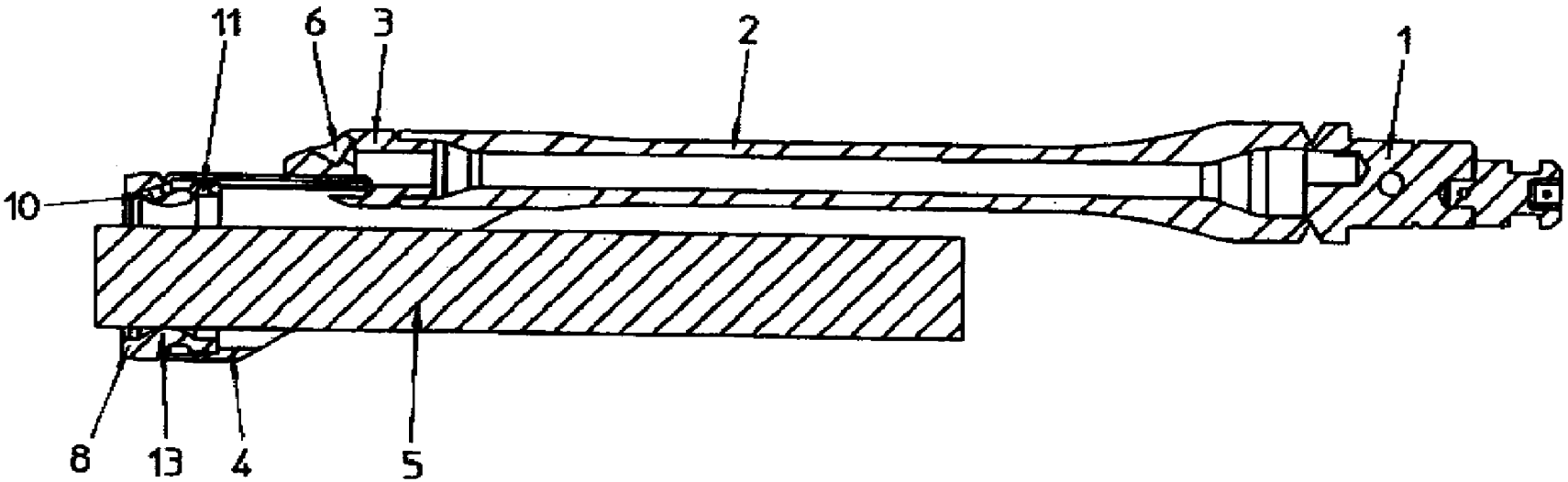
FIG. 3 is an axial longitudinal section of an overdrilling head of the overdrilling apparatus.

The overdrilling head 4 is provided on the inside with a centering protrusion in the form of a centering bead 13 which maintains the distance between the overdrilling head 4 and the old line 5 essentially constant, as shown in particular in FIG. 2. The provision of the centering bead 13 ensures that the overdrilling head 4 and in particular the cutting and reaming tools 9 are prevented from contacting the line 5 and thus from causing damage to the line 5.

The cutting and reaming tools 9 and nozzles 10, 11, 12 orbit the old line 5 about a partial arc of a circle as a result of the back-and-forth movement of the linkage 1 and create thereby not only the required clearance for withdrawing or pushing out the old line 5 but also substantially clear the line surface so that relatively little friction is encountered there despite the bottleneck between the centering bead 13 and the old line 5. Moreover, the nozzle 6 in the attachment piece 3 ensures an advance of the linkage 1 with little friction when the old line 5 is freed and during a rearward movement of the linkage 1 when a line section extending between a starting pit and a target pit is cleared and the linkage 1 is then retracted into the starting pit. The linkage 1 and the overdrilling head 4 may hereby be connected with a replacement line.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An apparatus for overdrilling a buried line, comprising:

a rotatably driven linkage; and a hollow cylindrical overdrilling head operated by the linkage and having an inner wall surface provided with at least one centering protrusion in confronting relationship to the buried line to center the buried line in relation to the overdrilling head, wherein the centering protrusion is shorter than the hollow cylindrical overdrilling head in a longitudinal direction of the hollow cylindrical overdrilling head.

2. The apparatus of claim 1, wherein the linkage is a thrust linkage and/or traction linkage.

3. The apparatus of claim 1, further comprising at least one nozzle disposed on the overdrilling head and defined by an exit axis which points slantingly with respect to a length axis of the overdrilling head.

4. The apparatus of claim 1, further comprising a plurality of nozzles disposed on the overdrilling head, wherein a first group of nozzles points in an advance direction of the overdrilling head, and a second group of nozzles points in an opposite direction.

5. The apparatus of claim 4, further comprising a nozzle ring connected to the overdrilling head, at least some of the plurality of nozzles being arranged in the nozzle ring.

6. The apparatus of claim 5, further comprising a rotary drive operatively connected to the nozzle ring.

7. The apparatus of claim 6, wherein the rotary drive is constructed to operate in two rotation directions.

8. The apparatus of claim 6, wherein the nozzle ring is equipped with cutting and/or reaming tools.

9. The apparatus of claim 1, further comprising a rotary drive operatively connected to the linkage for realizing a back-and-forth movement of the overdrilling head on a partial circle.

10. An apparatus for overdrilling a buried line, comprising:

a rotatably driven linkage; and a hollow cylindrical overdrilling head operated by the linkage and having an inner wall surface provided with at least one centering protrusion in form of a ring-shaped centering bead and arranged in confronting relationship to the buried line to center the buried line in relation to the overdrilling head.

11. An apparatus for overdrilling a buried line, comprising:

a rotatably driven linkage;

a hollow cylindrical overdrilling head operated by the linkage and having an inner wall surface provided with at least one centering protrusion in confronting relationship to the buried line to center the buried line in relation to the overdrilling head; and a flexible connection for flexibly connecting the overdrilling head to the linkage, wherein the centering protrusion is shorter than the hollow cylindrical overdrilling head in a longitudinal direction of the hollow cylindrical overdrilling head.

12. The apparatus of claim 11, wherein the linkage is a thrust linkage and/or traction linkage.

13. The apparatus of claim 11, wherein the flexible connection includes a bendable pipe piece arranged between the overdrilling head and the linkage.

14. The apparatus of claim 11, further comprising an attachment piece for connecting the overdrilling head with the bendable pipe piece.

15. The apparatus of claim 14, wherein the attachment piece is disposed in a recess of the overdrilling head.

16. The apparatus of claim 11, further comprising a measuring device disposed between the overdrilling head and the linkage for determining an actual disposition of the overdrilling head.

17. A kit for overdrilling a buried line, comprising:

a rotatably driven linkage;

a hollow cylindrical overdrilling head operated by the linkage and having an inner wall surface provided with at least one centering protrusion in confronting relationship to the buried line to center the buried line in relation to the overdrilling head; and a plurality of nozzle rings for selective connection to the overdrilling head, each nozzle ring being constructed with a particular array of nozzles so as to allow connection of nozzle rings with nozzles of different inclination and configuration, wherein the centering protrusion is shorter than the hollow cylindrical overdrilling head in a longitudinal direction of the hollow cylindrical overdrilling head.

18. The kit of claim 17, further comprising a rotary drive for operating a selected one of the nozzle rings when connected to the overdrilling head.

19. The kit of claim 18, wherein the rotary drive is constructed to operate in two rotation directions.

20. The kit of claim 17, wherein each of the nozzle rings is equipped with cutting and/or reaming tools.

21. An apparatus for overdrilling a buried line, comprising:

a rotatably driven linkage;

a hollow cylindrical overdrilling head operated by the linkage and having an inner wall surface provided with at least one centering protrusion formed as a ring-shaped centering bead and arranged in confronting relationship to the buried line to center the buried line in relation to the overdrilling head; and a flexible connection for flexibly connecting the overdrilling head to the linkage.

22. A kit for overdrilling a buried line, comprising:

a rotatably driven linkage;

a hollow cylindrical overdrilling head operated by the linkage and having an inner wall surface provided with at least one centering protrusion in form of a ring-shaped centering bead and arranged in confronting relationship to the buried line to center the buried line in relation to the overdrilling head; and a plurality of nozzle rings for selective connection to the overdrilling head, each nozzle ring being constructed with a particular array of nozzles so as to allow connection of nozzle rings with nozzles of different inclination and configuration.

* * * * *